US009689599B2

(12) United States Patent
Hollingworth

(10) Patent No.: US 9,689,599 B2
(45) Date of Patent: Jun. 27, 2017

(54) HEAT CYCLE FOR TRANSFER OF HEAT BETWEEN MEDIA AND FOR GENERATION OF ELECTRICITY

(71) Applicant: ENERGIHUSET FÖRSÄLJNINGS AB HARDY HOLLINGWORTH, Norrköping (SE)

(72) Inventor: Hardy Hollingworth, Norrköping (SE)

(73) Assignee: ENERGIHUSET FÖRSÄLJNINGS AB HARDY HOLLINGWORTH, Norrköping (SE)

( * ) Notice: Subject to any disclaimer, the term of this patent is extended or adjusted under 35 U.S.C. 154(b) by 466 days.

(21) Appl. No.: 14/387,207

(22) PCT Filed: Mar. 19, 2013

(86) PCT No.: PCT/SE2013/050305
§ 371 (c)(1),
(2) Date: Sep. 22, 2014

(87) PCT Pub. No.: WO2013/141805
PCT Pub. Date: Sep. 26, 2013

(65) Prior Publication Data

US 2015/0047378 A1 Feb. 19, 2015

(30) Foreign Application Priority Data

Mar. 20, 2012 (SE) ..... 1230028

(51) Int. Cl.
*F25B 49/02* (2006.01)
*F01K 25/08* (2006.01)
(Continued)

(52) U.S. Cl.
CPC ..... *F25B 49/025* (2013.01); *F01K 25/08* (2013.01); *F25B 11/00* (2013.01); *F25B 29/003* (2013.01);
(Continued)

(58) Field of Classification Search
CPC ..... F25B 9/06; F25B 2400/14; F25B 11/02; F25B 2400/0403; F25B 2400/0411; F01K 17/00
See application file for complete search history.

(56) References Cited

U.S. PATENT DOCUMENTS 7,523,621 B2 * 4/2009 Johansson ..... F01K 25/08 60/653
2009/0165456 A1 7/2009 Masada

FOREIGN PATENT DOCUMENTS

DE 102009020062 A1 12/2009
EP 0703420 A1 3/1996
(Continued)

OTHER PUBLICATIONS

PCT/ISA/210—International Search Report—Jul. 11, 2013 (Issued in Application No. PCT/SE2013/050305).
(Continued)

*Primary Examiner* — Cassey D Bauer
(74) *Attorney, Agent, or Firm* — Venable LLP; Jeffri A. Kaminski

(57) ABSTRACT

A heat pump circuit including a compressor that compresses a working fluid from a gas in a low pressure, low temperature first state to a high pressure, a high temperature second state. A first subflow of the working fluid is condensed into a gaseous/liquid mixture and assumes a third state by the working fluid delivering heat to a first medium. The first subflow of the working fluid is expanded and returns to a gas in the first state by absorbing heat from a second medium, whereupon the working fluid completes the cycle again. A second subflow of the compressed working fluid is expanded from the second state and the energy contents in the second subflow converted into electrical energy, whereafter the expanded working fluid is returned to the compressor after
(Continued)

passage of the evaporator, or after expansion in the energy converter from the second to the first state.

11 Claims, 4 Drawing Sheets

(51) Int. Cl.

| | |
|---|---|
| ***F25B 11/00*** | (2006.01) |
| ***F25B 41/00*** | (2006.01) |
| ***F25B 29/00*** | (2006.01) |
| ***F25B 31/02*** | (2006.01) |
| ***F25B 41/04*** | (2006.01) |
| ***F25B 41/06*** | (2006.01) |
| *F25B 25/00* | (2006.01) |

(52) U.S. Cl.

CPC ..... *F25B 31/02* (2013.01); *F25B 41/003* (2013.01); *F25B 41/043* (2013.01); *F25B 41/062* (2013.01); *F25B 25/005* (2013.01); *F25B 2339/047* (2013.01); *F25B 2400/0403* (2013.01); *F25B 2400/0409* (2013.01); *F25B 2400/0411* (2013.01); *F25B 2400/14* (2013.01); *F25B 2600/024* (2013.01); *F25B 2600/2501* (2013.01)

(56) References Cited

FOREIGN PATENT DOCUMENTS

| | | | |
|---|---|---|---|
| JP | 2005172336 | A | 6/2005 |
| JP | 2007132541 | A | 5/2007 |
| JP | 2009216275 | | 9/2009 |
| WO | WO-2005024189 | A1 | 3/2005 |
| WO | WO-2006066347 | A1 | 6/2006 |
| WO | WO-2011059131 | A1 | 5/2011 |

OTHER PUBLICATIONS

PCT/ISA/237—Written Opinion of the International Searching Authority—Jul. 11, 2013 (Issued in Application No. PCT/SE2013/050305).

* cited by examiner

HEAT CYCLE FOR TRANSFER OF HEAT BETWEEN MEDIA AND FOR GENERATION OF ELECTRICITY

CROSS-REFERENCE TO RELATED APPLICATIONS

This application claims priority to Swedish patent application 1230028-1 filed 20 Mar. 2012 and is the national phase under 35 U.S.C. §371 of PCT/SE2013/050305 filed 19 Mar. 2013.

TECHNICAL FIELD

The present invention relates to a system that utilizes a heat cycle in which heat is transferred between a working fluid from a region with a low temperature to a region with a higher temperature. Depending on whether it is the lower or the higher temperature that is desired, devices with such a cycle are designated cooling device or heat pump, respectively.

PRIOR ART

Refrigeration technology has been developed for a long time and is utilized in refrigeration plants, air conditioning systems and, recently, also fully developed in the reverse process, in so-called heat pumps for heating, for example, dwellings. The use of the concept heat pump may be looked upon as an "alias" for a refrigeration plant when a heat cycle is used for the purpose of cooling an area. Thus, the concept of heat pump will be used in the following to designate the device that uses a heat cycle for heating and cooling, respectively.

In a heat pump, a fluid operates which cyclically in a circuit passes through a compressor, a condenser and an evaporator, whereby the fluid delivers heat and absorbs heat, respectively, during the cycle. The heat pump here operates in a reversible Carnot process in a known manner, where the fluid receives an amount of heat $Q_c$ from a medium with a low temperature and delivers the amount of heat $Q_h$ to a medium with a higher temperature. For this process to be effected, work must be supplied according to the following proposition $$W=Q_h-Q_c$$

The efficiency of the process may be described as follows: $\eta=(Q_h-Q_c)/Q_c=1-T_c/T_h$ where $T_c$ temp. applies to the cold source and $T_h$ temp. applies to the hot source.

Usually, in connection with heat pumps, also the concept coefficient of performance, COP, is used, which may be used to assess the efficiency of a heat pump. For a reversible Carnot process, the coefficient of performance is written as follows:

$$COP_{H,rev}=1/(1-T_c/T_h)=T_h/(T_h-T_c),$$

which denotes the amount of heat that can be moved to the hot source from the cold source per input unit of work and is usually only designated COP and is often referred to as the COP value.

With the globally rising prices of energy of various kinds, solutions involving heat pump have increased significantly during the last decades, and a great deal of development and resources are invested by various operators to render heat pumps more efficient. For heat pumps today, coefficients of performance (COP values) of around 5 are achieved. This means that the heat pump optimally delivers 5 times as much energy as it consumes. Such optimum values may be achieved for, for example, heat pumps for geothermal heating, in which geothermal heat is utilized as the cold source for heating consumers with low requirements for temperature, for example in floor heating for dwellings.

Currently, considerable efforts are made to further increase the efficiency of heat pump systems. However, it has proved that it is difficult to reach further, since the technology has already been sophisticated to attain the high COP values mentioned above, among other things by introducing high-efficiency plate heat exchangers, low-energy centrifugal pumps, more energy-efficient scroll compressors and optimized refrigerant mixtures (i.e. the working fluids that complete the cycle in a heat pump cycle). Further, resources have been spent on achieving sophisticated control systems for controlling the cycle of the heat pump in an optimum way. Thus, it seems as if the technology has reached a limit that is difficult to exceed, other than by possibly increasing the coefficient of performance by tenths, when using conventional instruments.

In the prior art, in a circuit for a heat pump, a working fluid is used that is a medium, which during the cycle in the heat pump is transformed between different states of liquid, liquid/gaseous mixture and gas. The working fluid completes the cycle by being compressed, in a first stage in gaseous state from a first state with a low pressure $p_1$ and a low temperature $t_1$, to a second state with a high pressure $p_h$ and a high temperature $t_h$. Thereafter, the working fluid is heat-exchanged in a condenser in which the working fluid is cooled by a first medium belonging to a heat cycle, thus assuming a third state with a pressure $p_m$ and a temperature $t_m$, whereby $p_1<p_m<p_h$ and $t_1<t_m<t_h$. The working fluid is then moved on to an evaporator and is heat-exchanged therein with a second medium belonging to a collector circuit, where this second medium discharges heat to the working fluid, whereby the working fluid is expanded and essentially returns to the pressure and the temperature that prevail in the first state.

The prior art described may be exemplified by means of a heat pump that absorbs heat from, for example, the bedrock and, in the condenser, delivers heat to a heating system for, for example a dwelling. In such a heat pump, the necessary work in the compression of the working fluid is usually supplied by means of a compressor driven by an electric motor, which is here said to deliver the power P to the heat pump circuit. During the cycle, the working fluid, in the most optimal utilization, when the coefficient of performance amounts to 5, will in the condenser deliver a power 5P to the first medium that traverses a heat circuit, which is utilized in said heating.

During the passage through the condenser, the working fluid is cooled and will thus, as mentioned above, assume a state of a gaseous/liquid mixture. This mixture is passed further via a throttle valve to the evaporator, whereby the mixture is essentially given a liquid state, whereafter the working fluid in liquid state now expands into a working fluid in gaseous state. The steam generation heat that is required for the evaporation is absorbed in this case from the second medium, which also circulates in the evaporator for heat exchange with the working fluid. In this case, the absorbed power is 4P. The second medium traverses a collector circuit, which in the current example contains the second medium which in a suitable way is adapted to circulate in the rock for absorbing heat from the bedrock. In the prior art devices, the compressor, condenser and evaporator are designed in such a way as to supplement one another in an optimum manner and to deliver to the heat circuit the power that is required for the application in question.

When the working fluid leaves the compressor as a hot gas in a heat pump cycle and delivers heat to the condenser, the temperature and pressure of the hot gas fall significantly, whereby the hot gas, at least for the main part, is transformed into liquid. Non-utilized pressure and surplus temperature still remain in the working fluid to be utilized ahead of an expansion valve arranged upstream of the evaporator. The object of the expansion valve is to distribute a predetermined amount of working fluid to the evaporator in such a way that the expansion valve is controlled to expand the liquid flow downstream of the condenser. The liquid is expanded in the expansion valve such that it is given a lower pressure and a lower temperature before the liquid is expanded into steam in the evaporator.

Proposals for new, alternative solutions when utilizing a heat cycle in connection with heat pump systems are given, among other things, in the following documents:

JP2005172336, WO 2011059131, JP2007132541 and JP 2009216275 all show a turbine which utilizes surplus energy in the cycle and converts this into electrical energy. The turbine is located between the condenser and the evaporator. It is to be noted here that the turbine in these cases is connected serially in the circuit with the working fluid. These documents describe solutions intended to transform the above-mentioned surplus of temperature and pressure downstream of the condenser into electrical energy in that a turbine connected to a generator is to replace the expansion. However, it is very difficult to cause a turbine to function under the premises that prevail under the conditions that occur in the working fluid between the condenser and the evaporator.

US2009165456 shows a device in many different embodiments where, inter alia, there is a turbine for extracting electrical energy directly connected after the high-pressure side of the compressor in several of the embodiments. In the cycle, a pump is connected in the circuit after the condenser for increasing the pressure in the circuit. A plurality of heat exchangers and pumps render the device complicated.

Also document WO2005024189 (D1) discloses an alternative, where in a subflow energy contained in the working fluid is transformed into electrical energy. The device in the latter document has an embodiment where the greatest possible cooling is to be obtained in a fluid (7) which is heat-exchanged in an evaporator (4). To be able to achieve this maximum extraction of cooling, the working fluid in this subflow is condensed in an additional condenser 22 by heat interchange towards an additional heat carrier 21 with a low temperature. According to the embodiment in D1: FIG. 4 (p. 4, lines 1-4), the working fluid will assume four different states during the cycle.

It is an object of the present invention to provide a heat pump cycle that demonstrates a more efficient utilization of the available energy in a heat pump system.

DESCRIPTION OF THE INVENTION

The present invention constitutes a modification of a heat pump circuit according to the prior art. To this end, the primary aim has been to arrange the heat pump circuit, with certain means, such that more heat is absorbed from the collector circuit in a plant with a predetermined heating/cooling requirement. To achieve this, the electric motor is adapted to deliver more power to a compressor that is overdimensioned in relation to what is required to produce the necessary power to the heat circuit in the condenser or, in the case of cooing machines, the necessarily extracted power in the evaporator. By this measure, in case of a certain coefficient of performance, additional energy will be supplied to the working fluid in the heat pump circuit. This additionally supplied energy to the heat cycle cannot be delivered at the condenser since the heat cycle is designed for said required power. Instead, a bypass of the condenser is arranged from the outlet of the compressor via an energy converter to the inlet of the evaporator, or, alternatively (in certain operations) directly back to the inlet of the compressor depending on the degree of expansion of the working fluid in the turbine. In this bypass, the energy converter, which may be a gas turbine, is arranged in the gas flow from the compressor. The flow of hot gas with a high pressure and a high temperature out of the compressor is thus split up and is led partly to the condenser, partly to the energy converter. That part of the flow which flows through the energy converter and is then returned to the compressor without passing the condenser is flowing in a circuit which is here referred to as a converting circuit. Both the circuit which comprises the condenser and the converting circuit are traversed by the working fluid which is thus compressed, condensed and expanded in a similar manner in both the subflows. This means that the working fluid completes a Carnot cycle in the known manner, whereby the coefficient of performance for both the subflows of the working fluid in the complete heat pump circuit may be assigned a coefficient of performance that may amount to 5. That subflow of the working fluid that traverses the energy converter in the converting circuit is condensed into a gaseous/liquid mixture and thereby undergoes a process that resembles the conversion of gas from the first state to the second state of that subflow that passes through the condenser. If the energy converter is in the form of a turbine, the rotor therein is rotated by the hot gas flow and converts energy in the steam into mechanical energy that may be supplied to a generator for extracting electrical energy. This electrical energy may be used for operating the electric motor that drives the compressor or be delivered out on an electric network. The energy converter may, of course, by in the form of another type of machine that can utilize the energy contents of the working fluid for converting such energy contents into electrical energy. In the following, the concept turbine is used as an exemplification of each type of corresponding energy converter.

The invention may be generally exemplified as follows. It is assumed, as in the previous example according to the prior art, that the power requirement in a heat circuit for which the heat pump is designed amounts to 5P. Instead of designing the electric motor to deliver the power 1P to the compressor, as in the prior art, according to the invention the electric motor is designed for the power 2P to give an illustrative example. At the coefficient of performance 5, the power that the heat pump is capable of delivering will grow to 10P. The power obtained in the collector circuit grows to the magnitude 8P. Half of the power that the heat pump is able to deliver is passed, according to the example, to the heat circuit where the required power 5P may be transferred to the first medium in the heat circuit. The remainder of the extracted power 10P from the heat circuit, that is, 5P, will be available, via the bypass in the converting circuit, at the turbine and is thus delivered as useful energy to an electric generator that delivers the electrical energy as mentioned. The power output from the electric generator is determined, inter alia, by the efficiency of the turbine/generator package, in the following referred to as the converting unit. If it is assumed that this efficiency is 50%, the electric power delivered from the heat pump circuit will theoretically amount to 2.5P. Since a larger flow of working fluid will pass through the evaporator than what is the case in the corresponding conventional heat pump circuit referred to above, the evaporator needs to be upgraded to handle larger powers compared with the conventional example From what is shown according to the aspect of the invention, in case of an increase of input power to the compressor in the heat pump circuit, in a plant with a predetermined power requirement, a larger quantity of energy will be extracted from the collector circuit. Of course, according to the invention, the second medium that delivers heat to the evaporator needs to have a sufficient energy content to be able to contribute the increased power output that is required in the evaporator. In, for example, a plant for extracting geothermal heat, two boreholes in spaced relationship to each other may thus be required for the second medium, in such a plant where currently only one borehole is required in the case of a conventional plant.

According to one aspect of the invention, a method is illustrated. A device utilizing the method is presented.

One advantage of the converting unit according to the invention is that it makes possible the use of a resource, previously not fully utilized, in the form of a surplus of pressure and heat in the heat pump circuit. In addition, the invention contributes to improvement of the environment since considerably less electrical energy is consumed for a certain energy production in the form of an energy transfer in a heat pump. The potential of the invention may thus be great since its field of application is wide within the whole area of cooling/heating technology independently of the power range in question.

Additional advantageous embodiments of the invention are disclosed in the detailed description of the invention.

DESCRIPTION OF EMBODIMENTS

To implement the invention, a number of embodiments of the invention will be presented, reference also being made to the accompanying drawings.

Figure 1:
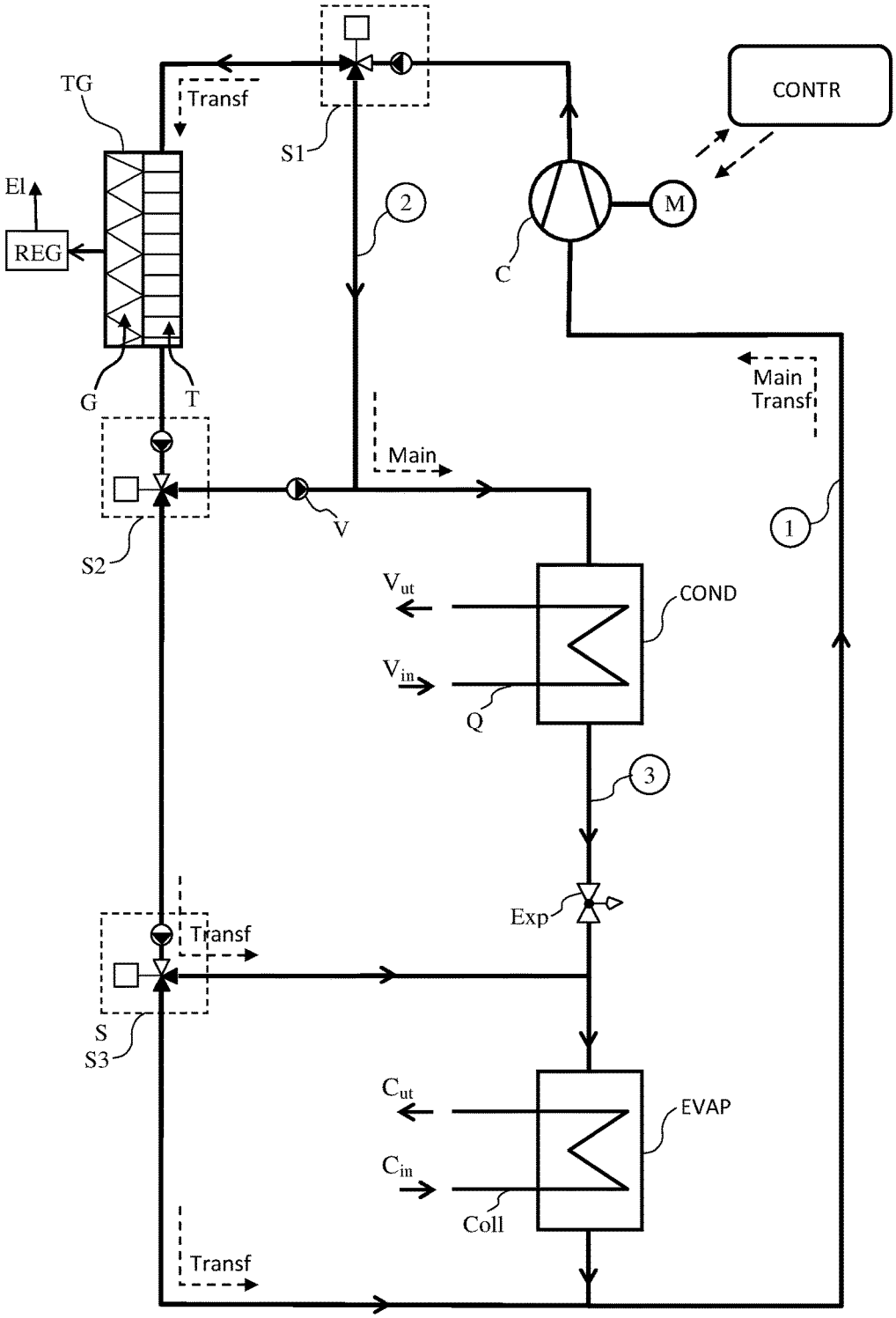
FIG. 1 shows a schematic general representation of a heat pump circuit according to the invention.

A main principle of the invention is shown in FIG. 1. The figure shows a complete heat pump according to the invention including a converting circuit that has been added in relation to the prior art. A refrigerant, here designated working fluid, circulates in the main circuit, designated Main, and in the converting circuit, designated Trans. The working fluid may be selected in dependence on the use of the heat pump. Various kinds of working fluids may be used for, for example, heating purposes and in cooling plants. As an example, R407C may be mentioned, which is used, inter alia, in geothermal heat pumps.

The following description is directed towards a heat pump that is used when heating dwellings based on extraction of energy from bedrock, lake or ground. The examples mentioned here relating to pressure, temperatures or other parameters thus refer to a heat pump of that kind. If a different use of the heat pump according to the invention will come into question, this means that different values of the parameters may apply.

Here, an overview is given of the data of the working fluid during its course through the heat pump cycle. The indicated values are only to be conceived as illustrative examples and may vary in dependence on the purpose in question. At point 1 in the figure, the working fluid in the cycle is in gaseous state, the first state, and may then have a pressure around 2 kPa and a temperature of around −5° C. When passing through the compressor C, the gas is compressed to the second state, which is a hot gas state (at 2). The pressure of the working fluid may then lie around 22 kPa and is temperature may amount to 120° C. The energy for compressing the working fluid in the compressor C is obtained by supplying electrical energy via the motor M. It is, of course, possible to supply energy to the compressor C with the aid of some other kind of mechanical work.

According to the invention, a first subflow of the working fluid, now in the form of hot gas, is forwarded in the main circuit Main to a condenser COND. The condenser is designed as a heat exchanger and in the example in question, where the heat pump heats a dwelling, the condenser COND is traversed by a first medium that circulates in a heat circuit Q, which may be in the form of radiators or floor-heating coils. In a known manner, the heat circuit Q has coils traversing the condenser. The first medium is usually water and is heated by the hot gas upon heat interchange with the working fluid as hot gas in the condenser. The heated water is circulated out into the heat circuit at $V_{ut}$ and is returned, at reduced temperature, at $V_{in}$ in the condenser COND. Thus, heat is transported away from the condenser while utilizing the heat circuit. The heat delivered by the working fluid in the condenser results in a temperature reduction of the hot gas, which is therefore largely condensed into liquid. A gaseous/liquid state arises in the working fluid. This has been referred to here as the third state (at 3). In this third state, the pressure may amount to about 10 kPa and the temperature may have fallen to about 65° C., all depending on the energy output in the condenser.

From the condenser the working fluid is forwarded in the main circuit main to an evaporator EVAP. Also the evaporator EVAP comprises a heat exchanger which in this cases absorbs heat from a second medium, a refrigerant medium, which circulates in a collector circuit Coll. The second medium (the refrigerant medium) is in the form of a medium essentially in liquid phase, for example a spirit-water solution, which in the case of geothermal, lake or ground heating circulates in a coil (the collector circuit) for absorbing heat from the rock, the lake or the ground in a known manner The collector circuit traverses the evaporator EVAP and forms therein a heat exchanger structure together with coils in the main circuit Main. The working fluid in the main circuit Main enters into the evaporator, essentially in liquid phase, and here absorbs heat from the refrigerant medium upon heat interchange therewith in the heat exchanger structure. Heat is supplied to the evaporator EVAP via the refrigerant medium which is introduced into the evaporator at its inlet C. This heat, added via the collector circuit, then evaporates the working fluid supplied to the evaporator essentially in liquid phase. The steam generation heat for the evaporation is obtained from the refrigerant medium. The refrigerant medium, thus cooled, is returned in the collector circuit to the heat source (rock, lake, ground) at the outlet $C_{ut}$.

The control of the amount of working fluid in gaseous/liquid phase that is allowed to enter the evaporator EVAP is normally controlled via an expansion valve Exp located between the condenser and the evaporator, which expansion valve, as mentioned, reduces the temperature and the pressure of the working fluid supplied to the evaporator EVAP essentially in liquid state. The operation of the heat pump circuit Main described so far in principle shows the function of a heat pump according to the prior art. According to this prior art, some energy is lost since the compressor C operates also when overpressure already exists in the circuit ahead of the expansion valve Exp.

According to one aspect of the invention, a second subflow of the working fluid is passed in a bypass conduit past the condenser COND with extraction of the working fluid at a first shunt valve S1 downstream of the outlet of the working fluid from the compressor C. This subflow thus flows in the converting circuit Transf. In this subflow in the converting circuit Trans, a converting unit TG is located which is traversed by the subflow before this is returned to the main circuit Main, either via a third shunt valve S3 to the inlet of the evaporator EVAP downstream of the expansion valve Exp, or via said third shunt valve S3 directly back to the compressor C. The third shunt valve may, under certain operating conditions, allow return to the main circuit Main according to both of these alternatives simultaneously, that is, return of the subflow of the working fluid from the converting circuit to the main circuit Main both before and after the evaporator EVAP.

The converting unit TG is in the form of an energy converter that converts energy contained in the working fluid into electrical energy and may be implemented by means of a steam turbine T integrated with a Generator G, but also by means of other types of corresponding machines. The turbine T is driven by the hot gas flow which is constituted by the subflow of the hot gas that comes out of the compressor C which, via the first shunt valve Si is controlled to flow through the turbine T. The generator G is driven by the turbine T, whereby the generator delivers electrical energy which may be used in the desired manner A new and unique aspect according to the invention is that surplus heat and surplus pressure, which according to the prior art cannot be utilized in the most efficient and practical way in a heat pump circuit, can now be controlled, by means of the invention, to be utilized with the converting unit TG. The turbine T may advantageously be designed as a two-stage turbine, in which the two turbine stages are mounted on the same shaft. Also the generator section is mounted on the same shaft as the shaft of the turbine T. Thus, the rotor section of the generator G may be integrated with the rotating section of the turbine T. The stator section of the generator G is suitably fixedly attached to a wall of the casing of the converting unit. Further, the stator section, together with the rotor section of the generator and the turbine T, are preferably integrated and arranged in a common pressure-tight casing. Since a steam turbine of the kind which may be used in this case rotates at high speeds of rotation, en electric generator of high-speed type should suitably be used, for example a generator G of high-speed type for direct-current (dc) generation, which provides technical advantages in connection with electric operation of external units and in view of inherent losses in the generator G and inherent losses in the electric motor M to the compressor in those cases where generated electricity is used for driving the electric motor. The generator may, for example, produce electrical energy which may be used as a contribution for driving the drive motor M of the compressor C. Alternatively, or simultaneously with feeding to the drive motor M, surplus of electricity may be fed out on an external electricity network. The converting unit TG thus contributes to reduce the drive motor's M need of electrical energy in dependence on the surplus of energy that is available in the heat pump circuit by means of the pressure and temperature drops that occur therein, and because of the increased available extraction of energy from the collector circuit that is created by designing the heat pump circuit in the described manner The compressor C may be a piston, scroll or screw compressor. The evaporator EVAP may, in its turn, be of the indirect evaporator type and is the usually in the form of a plate heat exchanger. Alternatively, evaporation may take place directly in, for example, an evaporation coil for earth/lake heating or may consist of a flange battery for air. Preferably, the compressor C is a speed-controlled dc compressor.

When utilizing a converting unit TG according to the invention, the evaporator may, in addition, have a shunted, fixed evaporation process by supplementing it with additional demand-controlled working fluid via an existing expansion valve Exp. This is done by the expansion valve being controlled by which value of the temperature absorption that the evaporation is allowed to have. By this method, maximum evaporation is achieved such that the compressor C is able to carry out its work without the risk of a breakdown caused by so-called liquid knock.

The principle of the invention is based on creating a higher flow of working fluid through the heat pump circuit than what is justified based on the predetermined requirement for a certain installation, such as in the examples where the predetermined requirement may be the power requirement in a heat circuit for heating purposes. This is achieved by introducing the extra subflow which, according to the invention, passes through the converting unit TG in parallel with the subflow in the ordinary heat pump circuit adapted to the predetermined requirement, in e.g. heating, according to the prior art. To be able to carry out this, it is required that the pressure and temperature of the subflow through the converting circuit Transf have essentially the same values as the values that the subflow in the main circuit Main has at the points where the subflows are reunited, which, as mentioned above, occurs at one or both of the two outlets of the shunt valve S3, that is, at any of the inlets or outlets of the evaporator.

Under certain operating conditions, it may be necessary to connect together the main circuit Main upstream of the condenser C with the converting circuit Transf for transferring working fluid from the converting circuit to the main circuit. A nonreturn valve V prevents the working fluid from flowing in the opposite direction.

FIG. 1 also shows a control unit CONTR. This control unit monitors the operating conditions that may occur for the operation of the heat pump. Thus, the control unit CONTR controls start and stop of the compressor C, control of flows of working fluid at the shunt valves S1, S2, S3, the expansion valve Exp, and also controls the voltage regulator REG that controls the voltage fed out from the generator G. Control of a heat pump is conventional technology, so the mode of operation of the control unit will not be described in detail here.

The converting unit may be located in different ways in the heat pump circuit and is then given somewhat different embodiments, but utilizes said surplus pressure/heat. One variant of an embodiment is to integrate the turbine section and the compressor/electric motor, in which case these are mechanically relieved and hence require lower energy for the operation. In this embodiment, no generator section is needed, which is a simplification per se but which requires redesign of the compressor unit.

Calculation Examples

Here, an example of a design of a heat pump circuit according to the invention will be described. The example is only intended to clarify the inventive concept in more detail and may only be conceived as an embodiment showing the principle and may not, as such, form the foundation of any basis for an argumentation against the invention. As such an example the below shows a theoretical calculation of parameters in a heat pump circuit according to the invention, based on a heat pump according to the Carnot principle:

Assumptions:

Determined heat requirement in an installation and extraction of water with an average temperature of +40° C. ($T_1$) at $V_{ut}$ in the heat circuit at the condenser COND: 8 kW (peak power).

Selected heat pump: 0-17 kW with speed-controlled dc operation of the compressor (thus overdimensioned in relation to the determined requirement).

Operating facts: Annual mean temperature (T2) of the refrigerant medium: +4° C., geothermal heating, direct return of working fluid from compressor, partly via condenser to evaporator, partly via converting unit to evaporator (i.e. return of surplus heat in hot gas after reduction of pressure/temperature in the turbine T):

$$T_1=40+273=313\ (K)$$

$$T_2=4+273=277\ (K)$$

Theoretically attainable coefficient of performance according to the formula:

$$\mathrm{COP}=T1/(T1-T2)=313/(313-277)=313/36=8.69$$

The practically feasible coefficient of performance (COP) of the heat pump, according to prior art, amounts to about 50% of the theoretically feasible due to pressure and heat losses.

Actual coefficient of performance of the heat pump circuit 0.5×8.69=4.35.

According to a first alternative, where the coefficient of performance 4.35 in case of a distribution of power with 8 kW to the condenser COND and 9 kW to the converting unit TG (i.e. with both direct return of hot gas via condenser COND and return of pressure-/temperature-reduced hot gas to evaporator EVAP without using a normally limiting expansion valve) gives Power requirement of the compressor for satisfying the heat requirement: 8 kW/4.35=1.84 kW.

Power requirement of the compressor for delivering the remaining (9 kW) available heat pump power (17 kW) to the converting circuit: 9 kW/4.35=2.07 kW.

Total required power consumption for output of maximum power: 3.91 kW.

The output maximum power from the converting unit TG at an assumed efficiency of 50% for this amounts to: 0.50×9 kW=4.5 kW.

According to a second alternative, the practically feasible efficiency for the converting circuit TG is assumed to constitute only 40% of the available (9 kW). The possible power output is 0.40×9 kW=3.6 kW.

The power requirement of the compressor for satisfying the heat requirement (via condenser) is the same as in alt. 1, i.e. 8 kW/4.35=1.84 kW, The power requirement of the compressor for delivering the remaining (9 kW) available heat pump power (17 kW) to the converting circuit: 9 kW/4.35=2.07 kW.

Total required power consumption for output of maximum power: 3.91 kW.

Thus, alternative 2 gives an additional requirement of 0.31 kW but, on the other hand, produces a maximum of 8 kW to the heat circuit and a maximum of 3.6 kW as electric power from the converting circuit TG.

Figure 2:
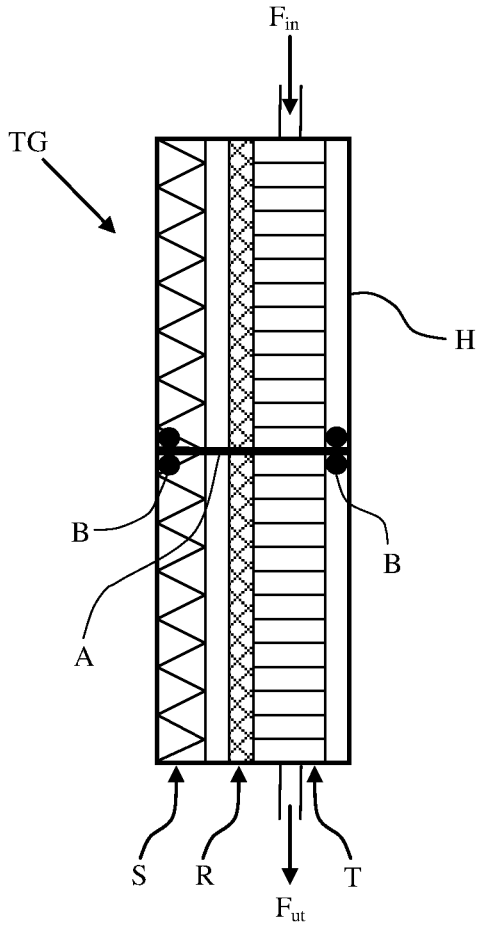
FIG. 2 shows a cross section of a schematic representation of a converting unit which, according to the invention, comprises an integrated turbine and a generator for transforming heat from the heat pump circuit into electrical energy.

The converting unit TG may be designed as this is shown in a cross section in FIG. 2. The turbine T is enclosed in a casing H and mounted on the shaft A. The shaft is journalled on bearing B at its respective ends at the sides of the casing H. Adjacent to and integrated with the turbine wheel on the turbine, a rotor section R of the generator G is attached. In this way, the rotor section R will rotate together with the turbine wheel of the turbine T. A stator section S of the generator G is fixedly attached to one wall of the casing H. In a known manner, a voltage is generated across a feed-out point from the generator when the turbine wheel rotates when steam from the inlet $F_{in}$ passes through the turbine T and is discharged via the outlet $F_{ut}$.

Figure 3:
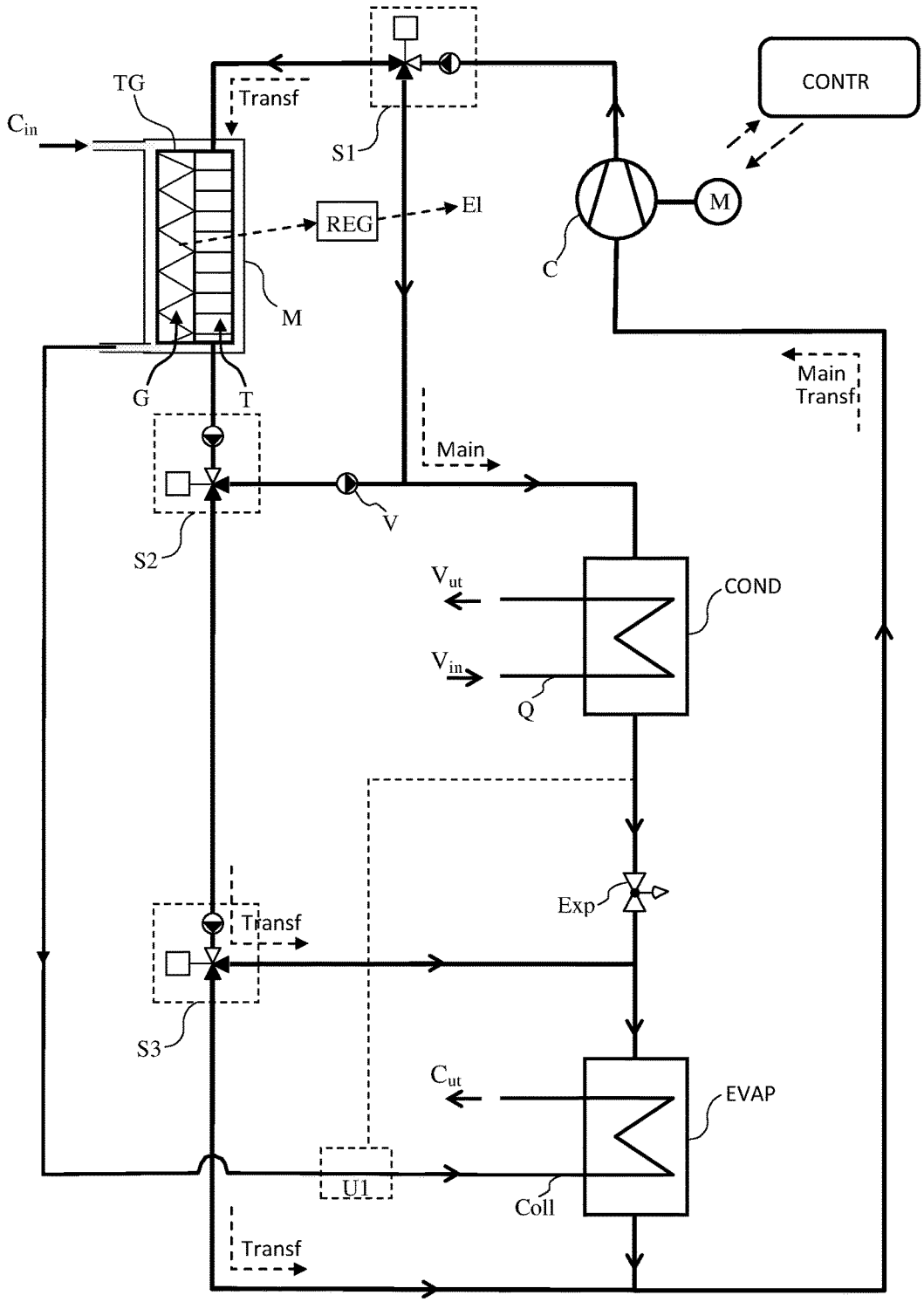
FIG. 3 shows a schematic representation of a heat pump circuit according to the invention, wherein a collector circuit absorbs surplus heat from the converting unit.

A further embodiment is shown in FIG. 3.

When the subflow of hot gas, which according to the invention passes through the converting unit, delivers rotatory energy to the turbine T, heat is also delivered to the material of the turbine itself. A certain generation of heat also arises in the parts of the generator G. To utilize all such surplus heat that has been delivered to the converting unit TG during operation, the casing that encloses the turbine T and the generator G in a pressure-tight manner, as shown in FIG. 3, is surrounded by a jacket or sheath M, thus forming a double shell and, between the two shells, a jacket space. The second medium, i.e. the refrigerant medium, is passed to this jacket space at the inlet $C_{in2}$ of the jacket space, said refrigerant medium thus being heated by the surplus heat from the enclosed converting unit TG. The second medium is returned, after the heat absorption, to the inlet at the evaporator EVAP (at the inlet designated $C_{in}$ in FIG. 1), whereupon the process proceeds as previously described. In this way, the hot gas flow is utilized for producing electrical energy via the turbine/generator and the residual heat is taken care of by returning it to the collector circuit.

Functional description of the heat pump circuit.

Upon start-up, the shunt valves S1 and S2 are kept closed for gas flow through the converting unit TG by means of control from the control unit CONTR. When the compressor C has attained working pressure with the aid of the controlled expansion valve Exp, the control unit CONTR provides opening impulses to the valves S1/S2 which in stages control a gas flow to the converting circuit Transf, whereby the turbine T with the generator G integrated into the converting unit TG starts generating electric voltage to a voltage regulator REG which regulates the feed-out of the electric voltage. When the turbine T and the generator G of the converting unit are in phase with the voltage of the heating pump, the control unit CONTR provides an impulse to the shunt valve S2 to completely open the converting circuit up to the evaporator EVAP. The shunt valve S1 is thereafter controlled via the voltage regulator REG and the control unit CONTR in such a way that the hot gas flow controls the generator voltage to the speed-controlled dc compressor C, which according to the invention is overdimensioned in relation to the requirement of heat in the heat circuit (alternatively, the requirement of "cooling" at the evaporator in the case of a refrigerating plant). The evaporator EVAP is directly fed with a restricted, controlled shunted gas/liquid flow of low pressure due to the fact that the pressure of the subflow passing the turbine T has fallen. Also the temperature of said subflow has fallen, since surplus heat has been discharged in the case where the converting unit TG is cooled. For optimum utilization of the working fluid in the evaporator EVAP, the shunt valve S3 that distributes fluid to the evaporator EVAP is controlled via the control unit CONTR. Under certain operating conditions, a more optimal situation is achieved by returning a certain part of the subflow that passes via the converting circuit Trans directly back to the suction side of the compressor C, which then operates in a pressure-relieved way (so-called capacity control). This control is executed by means of the shunt valve S3. Optionally, a subcooler U1 may be located in the collector circuit, which is traversed by the second medium, to utilize the residual surplus heat after the condenser COND in a maximum way. This belongs to the prior art and is illustrated by dashed lines in FIG. 3. The utilization of pressure and heat in the heat pump circuit according to the invention may be carried out in several alternative ways, of which only the preferred embodiments have been described here. The nonreturn valve V must be there in order to prevent the compressor's C own produced hot gas pressure, intended for the condenser, from causing an incorrect flow direction for the working fluid and creating operational disturbances in the heat pump circuit. The second shunt valve S2 may be controlled to return at least part of the second subflow of the working fluid (in the circuit Transf) to the main circuit Main, which may be advantageous under certain operating conditions.

Figure 4:
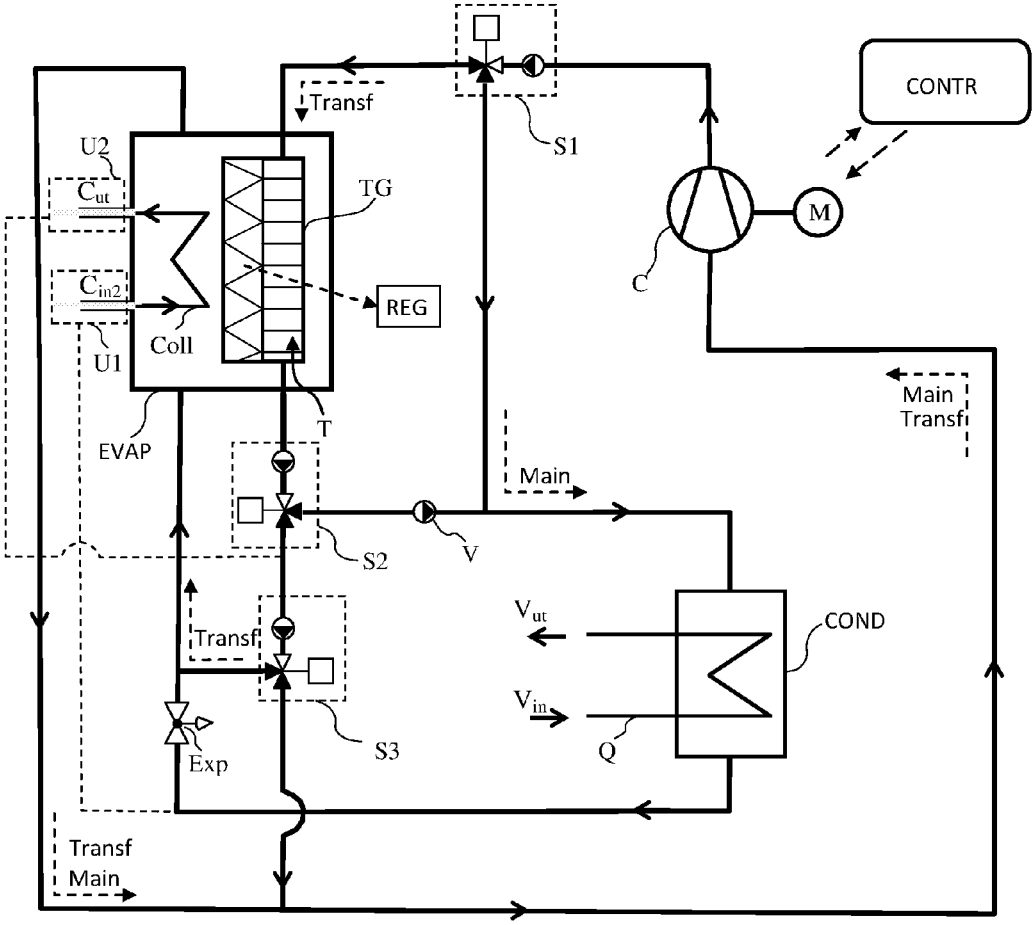
FIG. 4 shows a schematic representation of the heat pump circuit according to the invention, wherein the evaporator is integrated with the converting unit.

A heat pump designed according to the method may be given alternative embodiments. As an example, the evaporator EVAP and the converting circuit TG may be integrated with each other, for example in that the evaporator constitutes the external casing of the converting unit. By this design, all surplus heat from the converting unit TG may be transferred to the evaporator EVAP, which thus utilizes additional surplus energy. A design of the evaporator EVAP according to this principle is shown in FIG. 4. This variant may be the commercially most interesting one despite the fact that it is more complex in its structure. As options, subcoolers U1 and U2 may be arranged in a manner shown in FIG. 4.

Theoretical calculations when utilizing the possible applications of the converting unit in a heat pump circuit according to the aspects of the invention, here described based on the application according to FIG. 4:

According to a Mollier diagram applied to the working fluid R407C, this medium in the form of a hot gas with a pressure of 24 kPa and a temperature of about +100° C. is given a temperature amounting to about +20° C. if the pressure is reduced to about 4 kPa, when the medium passes, say, a 2-stage turbine which drives a high-speed generator. A commercially available speed-controlled dc-operated heat pump having a rated power of 0-17 kW has, as an example, a maximum hot gas flow of about 18 kbm/hour according to the technical specification from the manufacturer. This entails a maximum hot gas flow of about 300 liters/min or about 5 liters/sec. The energy content of this "mass flow" is split up by the shunt valve S1 which is a shunt valve controlled by the control unit CONTR. If the 2-stage turbine reduces the gas pressure 24 kPa to about 4 kPa, consequently more than 80% of the energy contents of the surplus pressure in the converting circuit Trans should be transformed into kinetic energy in the 2-stage turbine T and provide generation of heat in the whole converting unit TG. It is assumed in the example that pressure and temperature constitute equal parts in this process, as shown by a Mollier diagram. When a heat pump circuit is arranged according to the embodiment of FIG. 4 with the converting unit TG integrated/enclosed into the evaporator EVAP, largely all the heat losses in the converting unit TG will be supplied to the evaporator EVAP, which significantly increases the evaporation temperature for the whole heat pump circuit Main+Trans, i.e. both from the condenser COND via the expansion valve Exp (the normal path according to prior art)+"the direct gas mixture" that has passed via the integrated converting unit TG. With a correctly dimensioned evaporator EVAP and collector circuit, a considerably higher output of energy will then be made from the collector circuit, which enables output of electrical energy by using the already well-known and functioning cooling/heating pump technology. To make use of the residual pressure/temperature, i.e. the energy contents after the condenser outlet/passage, it is advantageous to connect a subcooler U1 in the incoming conduit $C_{in2}$ in series with the evaporator in the collector circuit, since the expansion valve Exp does not admit working fluid that has too high a pressure/temperature value and hence constitutes an unnecessary loss source. The same method of connection can also be utilized with a subcooler U2 placed in the outgoing conduit $C_{ut}$ in the collector circuit to reduce the temperature of the working fluid further after passage of the turbine T, thus making it possible to extract more energy from the subflow out of the turbine T prior to admission into the evaporator EVAP. This presupposes that it is economically justified to further optimize the evaporation temperature of the jointly linked subflows of the working fluid, the sum gas flow (at 3), which are to return to the suction side of the compressor C. In situations where too large a subflow has been created through the turbine T, surplus is shunted/bypassed via a controlled shunt valve S3 past the evaporator EVAP. This bypassed surplus is joined to the outflow from the evaporator EVAP and is passed to the suction side of the compressor C. The compressor will then be "pressure-relieved", which means that the energy consumption drops since minimum pressure differences are thus created.

As mentioned before, the heat pump circuit described here may also be used in cooling machines. In these applications, it is cooling of an external medium in the evaporator (EVAP) that is desired, for example air as the second medium, which in the evaporator (EVAP) passes through cooling coils with working fluid which absorbs heat from the air. If the invention described here is to be used in cooling machines, then, when designing the circuit, the starting-point is instead the cooling effect that is desired in the evaporator (EVAP), instead of what is mentioned in the above examples relating to heating purposes, where it is the energy requirement in the heat circuit of the condenser that controls the design of the circuit.

The invention claimed is:

1. A method in a refrigerant cycle comprising a working fluid, the method comprising:

compressing the working fluid in a cycle from a first state with a low pressure $p_l$ and a low temperature $t_l$ into a second state with a high pressure $p_{h-}$ and a high temperature $t_h$, cooling the working fluid such that the working fluid assumes a third state with a pressure $p_m$ and a temperature $t_m$, whereby $p_l < p_m < p_h$ and $t_l < t_m < t_h$, expanding the working fluid to essentially return to the pressure and the temperature that prevail in the first state before the working fluid is again compressed in the cycle, heat exchanging a first subflow of the compressed working in a condenser such that said cooling of the working fluid occurs via a first medium belonging to a heat cycle with coils through the condenser, where the first medium cools the working fluid which therefore assumes the third state, passing the working fluid on to an evaporator and heat-exchanging the working fluid therein with a second medium belonging to a collector circuit, where said second medium delivers heat to the working fluid, whereby the working fluid undergoes said expansion and essentially returns to the pressure and the temperature prevailing in the first state, cooling and expanding a second subflow of the compressed working fluid from the second state upon passage through an energy converter according to the following modes of operation:

reducing the pressure and temperature upon passage through the energy converter such that the working fluid is expanded essentially into the third state and is returned to the first state in the cycle by further expansion in the evaporator in a first mode of operation; and, reducing the pressure and temperature upon passage through the energy converter such that the working fluid from the second state is expanded essentially back to the first state and is returned to the cycle for compression in a second mode of operation; and converting with the energy converter work extracted during expansion of the working fluid in the energy converter into electrical energy, where the energy converter comprises a turbine driving a generator.

2. The method according to claim 1, wherein:

the distribution of working fluid to the first and second subflows, respectively, and return of working fluid in the second subflow to the first state according to any of the alternatives, are controlled by a control unit via controllable shunt valves.

3. A device, comprising:

a compressor, a condenser, an evaporator and an energy converter (TG) in a circuit traversed by a working fluid, wherein the compressor compresses the working fluid from a gas in a first state with a low pressure $p_l$ and a low temperature $t_l$ into a gas in a second state with a high pressure $p_h$ and a high temperature $t_h$, wherein a first subflow of the working fluid is passed in a main circuit and is condensed into a gaseous/liquid mixture upon passage through the condenser and thus assumes a third state with a pressure $p_m$ and a temperature $t_m$ by the working fluid delivering heat to a first medium belonging to a first heat cycle, where the first medium is heat-exchanged with the working fluid in the condenser and where the following applies: $p_l < p_m < p_h$ and $t_l < t_m < t_h$, said first subflow of the working fluid is forwarded from the condenser, is expanded in the evaporator and thereby returns to a gas in the first state by absorbing heat from a second medium in a collector circuit connected to the evaporator, wherein the second medium is heat-exchanged with the working fluid, whereupon the working fluid is returned to the compressor and completes the cycle again, wherein a second subflow of the compressed working fluid is expanded from the second state prevailing at the outlet of the compressor and is passed in a converting circuit to an energy converter for converting the energy contents of the second subflow of the working fluid that traverses the energy converter into electrical energy, whereupon expanded working fluid from the outlet of the energy converter is returned to the compressor according to the following modes of operation from the energy converter directly to the evaporator for further expansion, in a first mode of operation; and directly back to the compressor after expansion in the energy converter from the second state to the first state in a second mode of operation.

4. The device according to claim 3, further comprising:

a control unit configured to drive the device for different operating conditions, wherein the control unit controls a first shunt valve for distribution of the first and second subflows of the working fluid, and further controls a second shunt valve and a third shunt valve for selecting the operating condition by returning the working fluid from the second subflow to the compressor according to any of modes of operation.

5. The device according to claim 4, further comprising:

a speed-controlled motor which drives the compressor, whereby the control unit controls the energy supply to the compressor by controlling the motor to adapt the device to different operating conditions.

6. The device according to claim 5, wherein the control of the quantity of working fluid in gaseous/liquid phase that is allowed to enter the evaporator is controlled by the control unit via a controllable expansion valve located between the condenser and the evaporator.

7. The device according to claim 3, wherein the energy converter comprises a turbine that is traversed by the second subflow of the working fluid and a generator that is driven by the turbine, whereby both the turbine and the generator are preferably integrated and enclosed in a common pressure-tight casing.

8. The device according to further comprising:

a pressure-tight casing enclosing the energy converter that is traversed by the second subflow of the working fluid, wherein the evaporator is adapted to surround the casing that is pressure-tight for the energy converter, whereby the evaporator (EVAP) is adapted to utilize surplus heat leaking out from said pressure-tight casing.

9. The device according to claim 7, wherein the turbine has at least one turbine stage with at least one turbine rotor, wherein said at least one turbine rotor is rotated by the second subflow in the form of a hot gas, and wherein the rotor of the generator is mounted on the same shaft as the at least one turbine rotor of the turbine.

10. The device according to claim 3, further comprising:

a voltage regulator to which the electric voltage that is generated in the energy converter is passed, wherein the voltage regulator is controlled by the control unit to regulate a voltage delivered from the voltage regulator in relation to the current operating conditions for the device.

11. The device according to claim 7, wherein the stator of the generator is integrated with the pressure-tight casing.

* * * * *